United States Patent [19]

Echols

[11] Patent Number: 4,653,947

[45] Date of Patent: Mar. 31, 1987

[54] REINKING DEVICE FOR RIBBON CARTRIDGE

[75] Inventor: James R. Echols, Duluth, Ga.

[73] Assignee: Echodata Corporation, Norcross, Ga.

[21] Appl. No.: 836,298

[22] Filed: Mar. 5, 1986

[51] Int. Cl.[4] ..... B41J 31/14

[52] U.S. Cl. ..... 400/202.4; 400/196.1

[58] Field of Search ..... 400/196.1, 202.4

[56] References Cited

U.S. PATENT DOCUMENTS

| | | | |
|---|---|---|---|
| 2,074,971 | 3/1937 | Pelton | 400/202.4 X |
| 2,770,215 | 11/1956 | Knight | 118/260 |
| 2,969,865 | 1/1961 | Long | 400/200 |
| 3,887,056 | 6/1975 | Lehmann | 400/196 |
| 4,153,378 | 5/1979 | Scherrer et al. | 400/196.1 |
| 4,213,715 | 7/1980 | Haftmann et al. | 400/196.1 |
| 4,536,098 | 8/1985 | Sheehan et al. | 400/202.4 X |

FOREIGN PATENT DOCUMENTS

| | | | |
|---|---|---|---|
| 1159714 | 1/1984 | Canada | 400/202.4 |
| 19649 | 12/1980 | European Pat. Off. | 400/202.4 |
| 2550305 | 5/1977 | Fed. Rep. of Germany | 400/202.4 |
| 5782 | 1/1981 | Japan | 400/202.4 |
| WO85/01017 | 3/1985 | PCT Int'l Appl. | 400/202.4 |

OTHER PUBLICATIONS

*The Second Annual Guide to Ribbons*—"Ribbon Re-inking–A Case Study" by Robert W. Zolg, Dec., 1980, pp. 44–48.

Printer Ribbon Cartridge for OKIDATA Microline Printers.

*Primary Examiner*—Edgar S. Burr
*Assistant Examiner*—James R. McDaniel
*Attorney, Agent, or Firm*—Jones & Askew

[57] ABSTRACT

A reinking device for an endless-ribbon cartridge used with computer printers, typewriters and the like. A pinch roller is mounted for rotation on an inker case, and a porous ink-impregnated inking roller is mounted on the inker case tangent to the pinch roller to maintain a constant relation therewith. The inker case is pivotally mounted within the cartridge housing and spring biased such that the pinch roller mounted to the inker case is urged into frictional contact with a drive roller with the ribbon passing therebetween. As the drive roller is rotated by the printer mechanism to transport the ribbon, the pinch roller in frictional contact therewith rotates. The inking roller is rotated by the pinch roller and transfers a coating of ink to the pinch roller such that the pinch roller not only maintains the ribbon in frictional engagement with the drive roller but also reinks the ribbon as the ribbon passes thereagainst.

6 Claims, 3 Drawing Figures

REINKING DEVICE FOR RIBBON CARTRIDGE

TECHNICAL FIELD

The present invention relates generally to ribbon cartridges for use in computer printers, typewriters, and the like, and relates more specifically to a reinking device disposed within the cartridge and operative to reink the endless ribbon stored therein.

BACKGROUND OF THE INVENTION

Ribbon cartridges for use with computer printers, typewriters, and the like, are well known in the art. Typically, such cartridges have a housing defining a storage chamber therein for storing an endless ink ribbon in a plurality of loops. The housing includes means for guiding successive portions of the endless ribbon out of the storage chamber, outside of the housing where the ribbon is engaged by the printing mechanism of the printer or typewriter, and back into the housing and to the storage chamber. A drive roller mounted for rotation within the housing engages successive portions of the ribbon to move it along its path, and a pinch roller spring biased against the drive roller is often provided with the ribbon running therebetween to provide for positive engagement of the ribbon by the drive roller.

Typically, the supply of ink with which the ribbon is impregnated will be exhausted long before the ribbon wears out. As the ribbon's supply of ink becomes depleted, print quality becomes increasingly lighter. Finally, the quality of the print becomes so light as to be unacceptable, and the ribbon cartridge must be discarded.

In order to derive further use from the ribbon cartridge, it is known in the art to provide apparatus disposed within the cartridge housing to reink the ribbon. A typical prior art reinking arrangement is shown in U.S. Pat. No. 4,213,705. A porous roller saturated with ink is mounted for rotation within the housing, and a coating roller is mounted for rotation tangentially to the inking roller. The endless loop ribbon is brought into contact with a portion of the coating roller as it is drawn along its path. Ink is transferred from the inking roller to the coating roller and thence to the ribbon so that the ribbon is continuously reinked.

Such arrangements suffer a number of disadvantages, among them being the necessity of additional components separate from those required to transport the ribbon. Not only do these additional components complicate the assembly of the cartridge, but they also present space considerations, since they take up room which could otherwise be used to store additional ribbon in the cartridge, or to reduce the size of the cartridge.

Such considerations become even more important in light of the current trend to downsize printers. As the overall dimensions of the printer are reduced, the space available for the ribbon cartridge is at a premium. Typically, where a standard ribbon cartridge might store forty-five feet of ribbon, the new smaller ribbon cartridges used in compact printers, such as the Okidata 192, include space to store only six feet of ribbon. Thus, while apparatus for reinking this short length of ribbon is necessary to prevent it from having to be replaced 7½ times more often than a standard ribbon cartridge, the very size constraints that limit the length of the ribbon also limit the amount of space available for a reinking apparatus.

Accordingly, there is a need to provide a reinking apparatus for use in ribbon cartridges which minimizes the number of additional components necessary to accomplish its task.

One design which has sought to provide a compact reinking apparatus requiring a minimum of additional components is embodied in the ribbon cartridge provided as original equipment for the Okidata 182/192 series of printers. This reinking apparatus employs the pinch roller as the coating roller, thereby eliminating the need for a separate coating roller. However, where a separate coating roller can be mounted in a fixed position within the cartridge housing to maintain constant contact with the ink reservoir, a pinch roller is movably mounted within the cartridge housing and spring biased against the drive roller. Thus, apparatus must be provided which maintains contact between the ink reservoir and the movable pinch/coating roller.

The aforementioned Okidata cartridge attempts to solve this problem by employing an ink reservoir including a flexible wick disposed to contact the pinch roller. The wick transfers ink from the reservoir to the pinch roller, and the pinch roller thus reinks the ribbon in addition to maintaining the ribbon in frictional contact with the driven take-up roller. As the pinch roller moves toward or away from the drive roller, the wick flexes to maintain contact therewith. However, this arrangement suffers the disadvantage that a wicking action does not transfer ink to the pinch roller nearly as evenly as a rotating inking roller in actual physical contact with a transfer roller. Uneven ribbon inking results, causing light and dark areas of print known as "hot spots", resulting in print quality which is unacceptable to the end user.

Accordingly, there is a need to provide a ribbon reinking apparatus which maintains constant physical contact with the movable pinch roller while providing an even transfer of ink to the pinch roller.

SUMMARY OF THE INVENTION

The present invention overcomes these and other disadvantages associated with the prior art reinking devices for ribbon cartridges. Stated generally, the present invention comprises a reinking device for use in ribbon cartridges for computer printers, typewriters, and the like, which combines the function of the coating roller with the pinch roller to minimize the number of additional components which must be disposed within the housing. The improved reinking apparatus provides a means for maintaining constant contact between the ink reservoir and the movable pinch roller, while providing for a more constant and even transfer of ink to the pinch roller than heretofore possible. The reinking device of the present invention provides a uniform print quality and eliminates the "hot spots" which are unacceptable to the end user.

Stated more specifically, the improved reinking device of the present invention includes a pinch roller mounted for rotation on an inker case. A porous inking roller is mounted for rotation on the inker case tangent to the pinch roller. The inker case is movably mounted within the storage chamber of the ribbon cartridge such that the pinch roller mounted to the inker case is movable toward and away from the drive roller. The entire inker case is spring biased to urge the pinch roller toward the drive roller for frictional engagement therewith. Since the position of the inking roller is fixed with relation to the pinch roller, the inking roller maintains constant contact with the pinch roller as the pinch roller is biased against the drive roller. In this manner, the pinch roller can be used as a coater roller without having to provide an additional component, and the ink reservoir can be maintained in constant contact with the pinch roller despite the necessity for movably mounting the pinch roller within the cartridge housing.

A further advantage of the present invention is the use of a rotatable inking roller. As the drive roller turns, the pinch roller biased thereagainst is rotated. The inking roller tangentially contacting the pinch roller is rotated in turn. Centrifugal forces generated by the rotation of the porous inking roller gently force ink toward the outer circumference of the inking roller. Thus, a ready supply of ink is always available at the periphery of the inking roller for transfer to the pinch roller. The result is a more constant transfer of ink to the pinch roller than could be achieved by a wicking action alone.

Thus, it is an object of the present invention to provide an improved reinking device for ribbon cartridges for computer printers, typewriters, and the like.

It is a further object of the present invention to provide a reinking device which is compact and occupies a minimum of space within the storage chamber of the ribbon cartridge.

It is yet another object of the present invention to provide a reinking apparatus which utilizes existing components within the ribbon cartridge, thereby minimizing the number of additional components necessary to reink the ribbon.

Another object of the present invention is to provide a reinking device which provides an even supply of ink to the coating roller.

Other objects, features, and advantages of the present invention will become apparent upon the reading the following specification when taken in conjunction with the drawing and the appended claims.

DETAILED DESCRIPTION OF THE DISCLOSED EMBODIMENT

Figure 1:
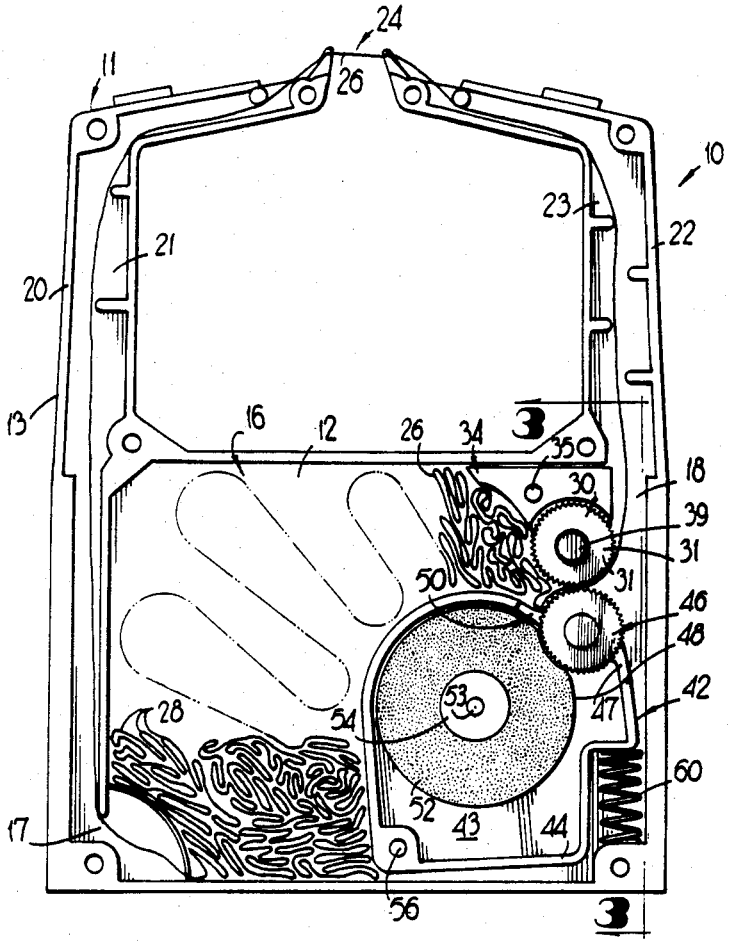
FIG. 1 is a top view of a ribbon cartridge with reinking device according to the present invention, with the top removed to reveal interior detail.
Figure 3:
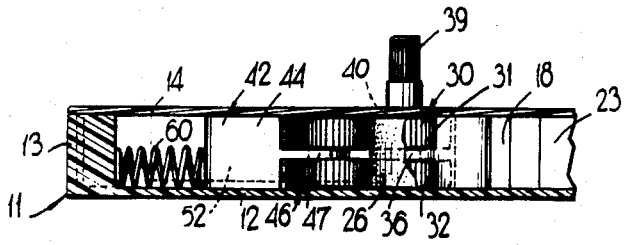
FIG. 3 is a side cutaway view of the reinking device taken along line 3—3 of FIG. 1.
Figure 2:
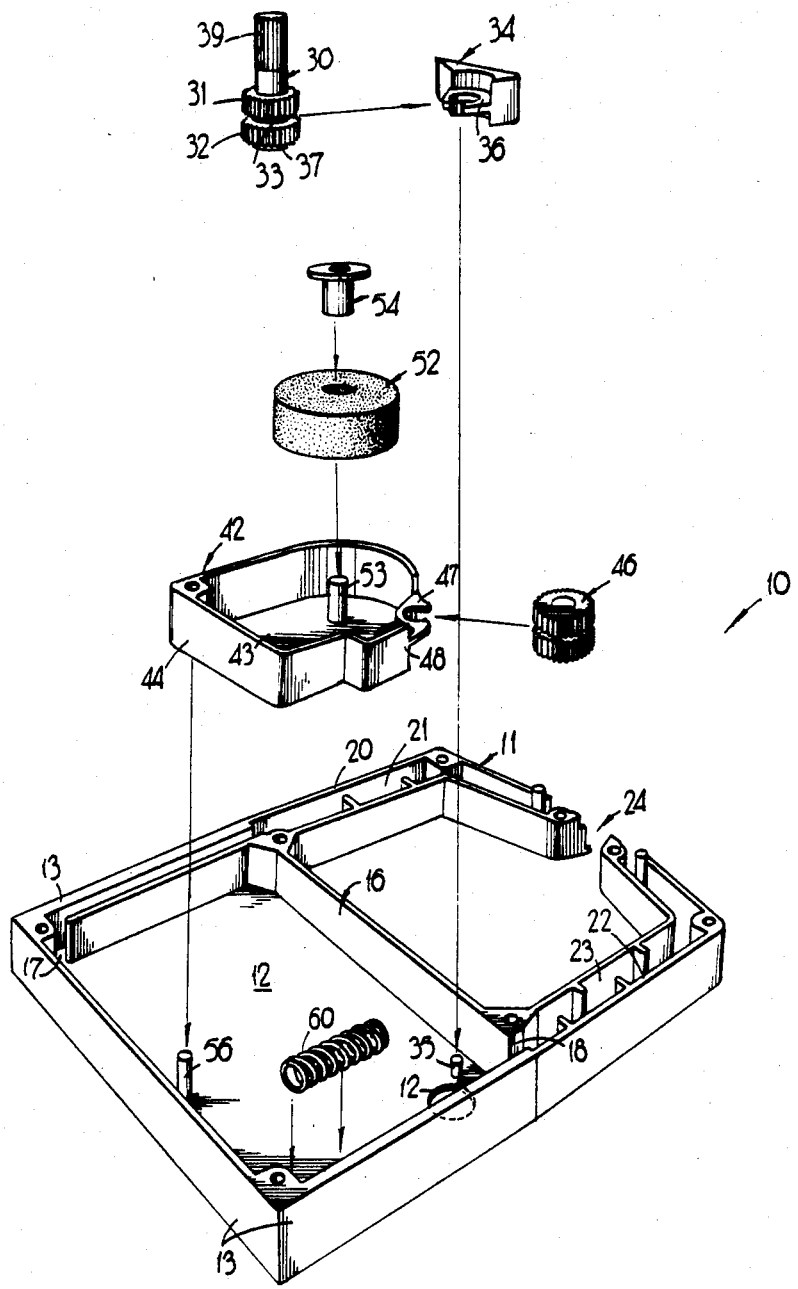
FIG. 2 is an exploded perspective view of the ribbon cartridge of FIG. 1 with the ribbon removed.

Referring now in more detail to the drawing, in which like numerals indicate like elements throughout the several views, FIGS. 1–3 show a printer ribbon cartridge 10 including an improved reinking device according to the present invention. While the drawings show a printer ribbon cartridge specifically designed for the Okidata 182/192 dot-matrix printers and compatibles, it will be understood that the reinking device of the present invention can be adapted for use with other types of ribbon cartridges for other computer printers, typewriters, and the like.

The cartridge 10 includes a housing 11 having a base 12, side walls 13 depending upwardly therefrom, and a top 14 (FIG. 3) removably mounted to the top of the side walls. The housing 11 defines a storage chamber 16 having a supply aperture 17 and a return aperture 18 at opposite ends of the storage chamber. A supply guide arm 20 has a ribbon conduit 21 formed therein in communication with the supply aperture 17. Similarly, a return guide arm 22 has a ribbon conduit 23 formed therein in communication with the return aperture 18. The ends of the supply arms 20, 22 remote from the storage chamber 16 are separated by an opening 24.

As shown in FIG. 1, an endless length of inked nylon ribbon 26 has its major portion disposed in the storage chamber 16 in a series of loops or folds 28. A minor portion of the ribbon 26 passes through the supply aperture 17 and through the conduit 21 in the supply guide arm 20. The ribbon then travels from the supply guide arm 20 across the opening 24 to the return guide arm 22, whence it is returned through the conduit 23 and the return aperture 18 to the storage chamber 16. That portion of the ribbon 26 extending outside the cartridge 10 across the opening 24 between the guide arms 20 and 22 is engageable by a print head mechanism (not shown) in a conventional manner.

Disposed within the storage chamber 16 adjacent to the return apparature 18 is a drive roller 30. The drive roller 30 includes upper and lower toothed drive elements 31, 32 and a journal 33 formed therebetween. A block 34 mounted upon a pin 35 within the storage chamber 16 has a bearing collar 36 dimensioned to receive the journal 33 of the drive roller 30. In this manner, the drive roller is mounted for rotation within the storage chamber.

The drive roller 30 further includes a lower spindle section 37 having slots (not shown) formed in the lower end thereof, which slots are engageable by a printer mechanism through a hole 38 in the housing base 12 in the conventional manner to rotatably drive the drive roller. A knurled upper spindle 39 extends from the upper portion of the drive roller 30 and protrudes through a hole 40 in the top 14 of the cartridge housing 11 to provide a means whereby the drive roller can be turned manually from outside the housing.

Mounted within the storage chamber 16 is a support member or inker case 42 having a base 43 and vertical walls 44 depending upwardly therefrom. A pinch roller 46 is mounted for rotation on a bearing collar 47 formed at the edge 48 of the inker case 40 such that a section of the pinch roller protrudes through an aperture 50 in the vertical walls 44.

The drive roller 30 and pinch roller 46 of the disclosed embodiment are formed by injection molding solid plastic materials such as polyamide resins. The rollers have a plurality of teeth formed in the circumferential surface of the drive elements which "bite" into the ribbon to provide a very positive drive. However, it will be understood by those skilled in the art that drive and pinch gears of alternative constructions, such as rubber drive rings mounted upon plastic spindles, may be employed without departing from the scope and spirit of the appended claims. Similarly, while the rollers of the present invention include upper and lower drive elements, drive rollers of other designs having only a single drive element or having more than two drive elements may be employed with similar results.

A porous inking roller 52 is mounted for rotation upon a spindle 53 within the inker case 40. The inking roller is of a cellular material generally used in reinking and is substantially saturated with ink. A cap 54 retains the inking roller 52 on the spindle 53. When mounted in this manner, the inking roller is substantially tangent to the pinch roller 46 and in frictional engagement therewith.

The entire inker case 42 is pivotally mounted upon a post 56 so that the portion of the pinch roller 46 protruding exteriorly of the inker case is movable into and out of engagement with the drive roller 30. A coil spring 60 interposed between the inker case 42 and a vertical wall 13 in the cartridge housing 11 biases the pivotally mounted inker case to bring the pinch roller into frictional engagement with the drive roller.

While the present invention discloses an inker case pivotally mounted upon a post within the storage chamber, it will be appreciated by those skilled in the art that alternate arrangements for movably mounting the inker case within the storage chamber may be employed to permit the pinch roller mounted upon the inker case to move toward and away from the drive roller. For example, the inker case may be provided with a guide member formed on its lower surface which engages a guide slot formed in the bottom of the cartridge housing. In such an arrangement, a leaf spring or the like could be provided to urge the pinch roller into frictional engagement with the drive roller by biasing the inker case along its guide slot.

With the inker case 42 pivotally mounted upon its post 56, the coil spring 60 bears against the inker case to urge the pinch roller mounted thereto into frictional engagement with the drive roller 30. Since the inking roller is also mounted to the inker case in fixed position relative to the pinch roller, movement of the inker case to bring the pinch roller into frictional engagement with the drive roller moves the inking roller therewith, continuously maintaining the physical engagement between the inking roller and the pinch roller.

The ribbon cartridge 10 is designed such that the drive roller 30 is rotated by a suitable drive mechanism which comes into driving connection with the slots in the lower spindle section 37 when the cartridge is mounted to the printer or typewriter. As the drive roller 30 is rotated, the pinch roller 46 in frictional contact therewith rotates in the opposite direction. The ribbon 26 interposed therebetween is thereby continuously transported to withdraw successive portions of the ribbon through the supply aperture 17 in the opposite end of the storage chamber 16. The successive portions of ribbon are then conveyed through the ribbon conduit 21 within the supply guide arm 20. The ribbon is then drawn across the opening 24 between the guide arms, where it is engaged by the printing mechanism. The ribbon is then received within the conduit 23 in the return guide arm 22. The ribbon then passes through the return aperture 18, between the drive roller 30 and the pinch roller 46, and into the storage chamber 16.

As the drive roller 30 and the pinch roller 46 rotate to transport the ribbon 26, the frictional engagement of the inking roller 52 with the pinch roller causes the inking roller to rotate upon its mounting post. As the inking roller rotates, centrifugal forces generated by the rotation of the inking roller gently force ink toward its outer circumference. Thus, a ready supply of ink is always available at the periphery of the inking roller for transfer to the pinch roller, thereby providing a more reliable transfer of ink to the pinch roller than could be achieved by wicking action alone.

As successive portions of the circumference of the rotating pinch roller contact the ink-laden periphery of the inking roller, a coating of ink is applied to the pinch roller. The ink-coated portion of the pinch roller then contacts the ribbon, reinking the ribbon as it passes between the pinch roller and the drive roller.

By employing a reinking device of the type herein disclosed, a twenty-fold increase in the number of acceptable impressions can be obtained. Thus, despite the fact that the ribbon in the Okidata 182/192-compatible cartridge is less than one-seventh the length of the ribbon in a conventional cartridge, the ribbon cartridge of the present invention will provide acceptable print quality nearly three times longer than a conventional ribbon cartridge. While it can be appreciated that the reinking device herein disclosed is especially suited for use in downsized ribbon cartridges, the reinking device of the present invention can also be employed in conventionally sized ribbon cartridges, with a corresponding increase in cartridge life.

Finally, it will be understood that the preferred embodiment of the present invention has been disclosed by way of example, and that other modifications may occur to those skilled in the art without departing from the scope and spirit of the appended claims.

What is claimed is:

1. A ribbon reinking apparatus for use in a ribbon cartridge for computer printers, typewriters, and the like wherein said ribbon cartridge has a housing for storing a ribbon therein and a drive roller rotatably mounted within said housing for drawing said ribbon along a path, said reinking apparatus comprising:

a support member;

a pinch roller;

means for mounting said pinch roller for rotation upon said support member;

an ink reservoir;

means for mounting said ink reservoir to said support member, said ink reservoir mounting means being in fixed position relative to said pinch roller mounting means and said ink reservoir being in physical contact with said pinch roller such that ink is transferred from said ink reservoir to the circumference of said pinch roller;

means for movably mounting said support member within said housing such that said pinch roller mounted to said support member is movable toward and away from said drive roller; and means for biasing said support member such that said pinch roller mounted thereto is urged toward said drive roller for frictional engagement therewith, said pinch roller being rotatably driven by said drive roller with said ribbon passing therebetween such that successive portions of said ribbon are engaged by said drive roller and said pinch roller to draw said ribbon along said path, whereby said physical contact between said ink reservoir and said pinch roller causes ink to be transferred from said ink reservoir to the circumference of said pinch roller and thence to said ribbon passing thereagainst to reink said ribbon.

2. The ink ribbon cartridge of claim 1, wherein said ink reservoir comprises a porous inking roller, and wherein said means for mounting said ink reservoir comprises means for mounting said inking roller for rotation upon said support member, said inking roller having a circumference in frictional contact with the circumference of said pinch roller such that said rotational movement of said pinch roller causes said inking roller to rotate, whereby centrifugal forces from the rotation of said inking roller force ink toward the circumference of said inking roller to provide a constant supply of ink for ready transference to said pinch roller.

3. A ribbon reinking apparatus for use in a ribbon cartridge for computer printers, typewriters, and the like wherein said ribbon cartridge has a housing for storing a ribbon therein and a drive roller rotatably mounted within said housing for drawing said ribbon along a path, said reinking apparatus comprising:

a support member;

a pinch roller mounted for rotation upon said support member;

means for movably mounting said support member within said housing such that said pinch roller mounted thereto is movable toward and away from said drive roller;

means for biasing said support member such that said pinch roller mounted thereto is urged toward said drive roller for frictional engagement therewith, said pinch roller being rotatably driven by said drive roller with said ribbon passing therebetween such that successive portions of said ribbon are engaged by said drive roller and said pinch roller to draw said ribbon along said path; and an inking roller mounted within said storage chamber such that the axis of rotation of said inking roller is in a fixed position relative to the axis of rotation of said pinch roller, and such that the circumference of said inking roller maintains frictional contact with the circumferences of said pinch roller sufficient to rotatably drive said inking roller as said pinch roller moves into engagement with said drive roller, whereby ink is transferred from said inking roller to the circumference of said pinch roller, whereby said rotational movement of said pinch roller causes said inking roller in frictional contact therewith to rotate such that centrifugal forces from said rotation of said inking roller force ink toward the circumference of said inking roller, and whereby said frictional contact of the circumference of said inking roller with the circumference of said pinch roller causes ink to be transferred from the circumference of said inking roller to the circumference of said pinch roller and thence to said ribbon passing against said pinch roller to reink said ribbon.

4. A ribbon reinking apparatus for use in a ribbon cartridge for computer printers, typewriters, and the like wherein said ribbon cartridge has a housing for storing a ribbon therein and a drive roller rotatably mounted within said housing for drawing said ribbon along a path, said reinking apparatus comprising:

an inker case comprising a base and vertical walls depending upwardly therefrom;

means defining an aperture in said vertical walls;

a pinch roller mounted for rotation within said inker case such that a portion of said pinch roller extends through said aperture in said vertical walls outwardly of said inker case;

a porous inking roller rotatably mounted to said inker case, the axis of rotation of said inking roller being in fixed position relative to the axis of rotation of said pinch roller, the circumference of said inking roller being in frictional contact with the circumference of said pinch roller;

means for movably mounting said inker case within said housing such that said portion of said pinch roller extending outwardly of said inker case is movable into and out of engagement with said drive roller; and means for biasing said inker case such that said portion of said pinch roller extending outwardly of said inker case is urged into frictional engagement with said drive roller, said pinch roller being rotatably driven by said drive roller with said ribbon passing therebetween such that successive portions of said ribbon are engaged by said drive roller and said pinch roller to draw said ribbon along said path, whereby said rotational movement of said pinch roller causes said inking roller to rotate such that centrifugal forces from the rotation of said inking roller force ink toward the circumference of said inking roller to provide a constant supply of ink for ready transference to said pinch roller, and whereby said frictional contact of said circumference of said inking roller with the circumference of said pinch roller causes ink to be transferred from said inking roller to the circumference of said pinch roller and thence to said ribbon passing against said pinch roller to reink said ribbon.

5. An ink ribbon cartridge for computer printers, typewriters, and the like comprising:

a housing;

an endless ribbon having a major portion stored within said housing;

a drive roller rotatably mounted within said housing and operative to draw said ribbon along a path;

a support member;

a pinch roller mounted for rotation upon said support member;

a porous inking roller mounted for rotation upon said support member, the axis of rotation of said inking roller being in fixed position relative to the axis of rotation of said pinch roller, and said inking roller being in physical contact with said pinch roller such that ink is transferred from said inking roller to the circumference of said pinch roller;

means for movably mounting said support member within said housing such that said pinch roller mounted to said support member is movable toward and away from said drive roller; and means for biasing said support member such that said pinch roller mounted thereto is urged toward said drive roller for frictional engagement therewith, said pinch roller being rotatably driven by said drive roller with said ribbon passing therebetween such that successive portions of said ribbon are engaged by said drive roller and said pinch roller to draw said ribbon along said path, whereby said physical contact between said ink reservoir and said pinch roller causes ink to be transferred from said ink reservoir to the circumference of said pinch roller and thence to said ribbon passing thereagainst to reink said ribbon.

6. An ink ribbon cartridge for computer printers, typewriters, and the like comprising:

a housing defining a storage chamber therein for storing a major portion of an endless ink ribbon in a plurality of loops, said housing further defining means for guiding successive portions of said endless ribbon from said storage chamber, out of said housing, and back into said housing to said storage chamber;

a drive roller rotatably mounted within said storage chamber and operative to draw said ribbon along a path;

a support member;

a pinch roller mounted for rotation upon said support member;

a porous inking roller mounted for rotation upon said support member, the axis of rotation of said inking roller being in fixed position relative to the axis of rotation of said pinch roller, and said inking roller being in physical contact with said pinch roller such that ink is transferred from said inking roller to the circumference of said pinch roller;

means for movably mounting said support member within said housing such that said pinch roller mounted to said support member is movable toward and away from said drive roller; and means for biasing said support member such that said pinch roller mounted thereto is urged toward said drive roller for frictional engagement therewith, said pinch roller being rotatably driven by said drive roller with said ribbon passing therebetween such that successive portions of said ribbon are engaged by said drive roller and said pinch roller to draw said ribbon along said path, whereby said physical contact between said ink reservoir and said pinch roller causes ink to be transferred from said ink reservoir to the circumference of said pinch roller and thence to said ribbon passing thereagainst to reink said ribbon.

* * * * *